United States Patent [19]

Holden et al.

[11] Patent Number: 5,007,839

[45] **Date of Patent: * Apr. 16, 1991**

[54] VACUUM CLEANER HOSE CONSTRUCTION, INSERT THEREFOR AND METHODS OF MAKING THE SAME

[75] Inventors: Homer N. Holden, Sylva; Philip K. Loyer, Waynesville, both of N.C.

[73] Assignee: Dayco Products, Inc., Dayton, Ohio

[ * ] Notice: The portion of the term of this patent subsequent to Jan. 16, 2007 has been disclaimed.

[21] Appl. No.: 427,269

[22] Filed: Oct. 26, 1989

Related U.S. Application Data

[62] Division of Ser. No. 234,783, Aug. 22, 1988, Pat. No. 4,894,021.

[51] Int. Cl.[5] ..... H01R 4/60

[52] U.S. Cl. ..... 439/191; 439/395

[58] Field of Search ..... 439/191, 192, 395, 604, 439/606, 736, 398; 15/302, 332; 29/857, 858

[56] References Cited

U.S. PATENT DOCUMENTS

| | | | |
|---|---|---|---|
| 4,097,106 | 6/1978 | Over et al. | 439/398 |
| 4,466,677 | 8/1984 | Lyman | 439/192 |
| 4,557,543 | 12/1985 | McCleerey et al. | 439/395 |

*Primary Examiner*—Neil Abrams
*Assistant Examiner*—Khiem Nguyen
*Attorney, Agent, or Firm*—Joseph V. Tassone

[57] ABSTRACT

A vacuum cleaner hose construction, insert therefor and methods of making the same are provided, the vacuum cleaner hose construction comprising an elongated vacuum hose having an end and an electrical conductor extending therealong and being provided with an end portion at the end thereof, an electrical terminal connector carried by the hose and being fixed to the end portion, an enlarged cuff disposed onto the end of the hose and covering at least part of the connector to hold the connector and its interconnected end portion in a predetermined position on the hose, and an insert that initially holds the connector and its interconnected end portion in the predetermined position thereof before the cuff is disposed thereon, the insert also being at least partially covered by the cuff.

11 Claims, 2 Drawing Sheets

VACUUM CLEANER HOSE CONSTRUCTION, INSERT THEREFOR AND METHODS OF MAKING THE SAME

CROSS REFERENCE TO RELATED APPLICATION

This application is a divisional patent application of its copending parent patent application, Ser. No. 234,783, filed Aug. 22, 1988, now U.S. Pat. No. 4,894,021.

BACKGROUND OF THE INVENTION

1. Field of the Invention

This invention relates to a new vacuum cleaner hose construction and to a new method of making a vacuum cleaner hose construction, as well as to an insert for such a vacuum cleaner hose construction and to a method of making the insert.

2. Prior Art Statement

It is known to provide a vacuum cleaner hose construction that comprises an elongated vacuum hose having an end and an electrical conductor extending therealong and being provided with an end portion at the end, an electrical terminal connector carried on the hose and being fixed to the end portion, and an enlarged cuff disposed onto the end of the hose and covering at least part of the connector to hold the connector and its interconnected end portion in a predetermined position on the hose. For example, see the Holden U.S. Pat. No. 3,928,715; the Holden et al. U.S. Pat. No. 4,740,171 and the Reynolds et al. U.S. Pat. No. 3,972,578.

Also see the Tucci U.S. Pat. No. 3,935,628 and the Colter U.S. Pat. No. 4,005,517 for apparatus for applying terminal connectors in side-by-side relation to electrical conductors, such as electrical conductors on vacuum cleaner hoses.

SUMMARY OF THE INVENTION

It is one feature of this invention to provide a new vacuum cleaner hose construction with unique means for initially positioning an electrical terminal connector and its associated end portion of a conductor of the hose before an end cuff is disposed thereon.

In particular, it was found according to the teachings of this invention that a unique insert can be provided for holding the electrical terminal connector and its interconnected end portion of the conductor of the vacuum cleaner hose in a predetermined position before the end cuff is disposed thereon.

For example, one embodiment of this invention provides a vacuum cleaner hose construction that comprises an elongated vacuum hose having an end and an electrical conductor extending therealong and being provided with an end portion at the end, an electrical terminal connector carried by the hose and being fixed to the end portion, an enlarged cuff disposed onto the end of the hose and covering at least part of the connector to hold the connector and its interconnected end portion in a predetermined position on the hose, and an insert for initially holding the connector and its interconnected end portion in the predetermined position thereof before the cuff is disposed thereon, the insert also being at least partially covered by the cuff.

Accordingly, it is an object of this invention to provide a new vacuum cleaner hose construction having one or more of the novel features of this invention as set forth above or hereinafter shown or described.

Another object of this invention is to provide a new method of making a vacuum cleaner hose construction, the method of this invention having one or more of the novel features of this invention as set forth above or hereinafter shown or described.

Another object of this invention is to provide an insert for a vacuum cleaner hose construction, the insert of this invention having one or more of the novel features of this invention as set forth above or hereinafter shown or described.

Another object of this invention is to provide a method of making an insert for a vacuum cleaner hose construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
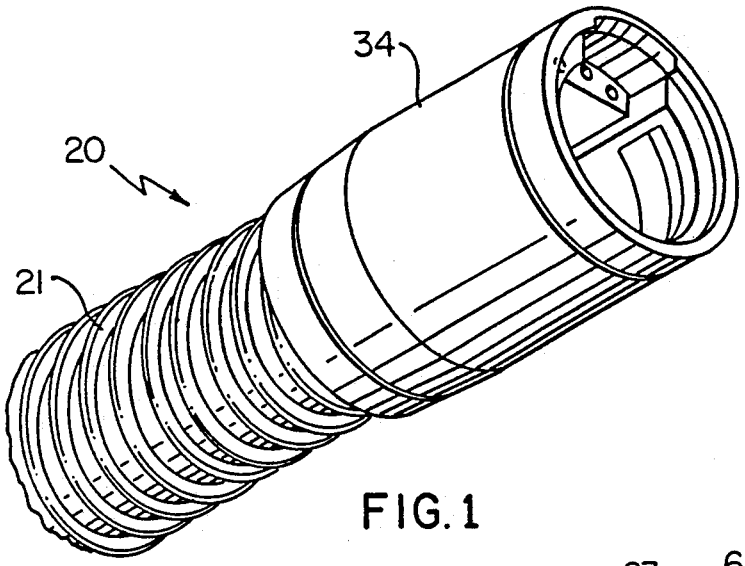
FIG. 1 is a fragmentary perspective view of one end of the new vacuum cleaner hose construction of this invention.
Figure 3:
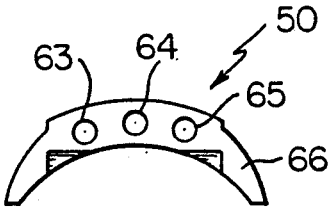
FIG. 3 is an end view of the insert of FIG. 2 and is taken in the direction of the arrows 3—3 of FIG. 2.

While the various features of this invention are hereinafter illustrated and described as being particularly adapted to provide an insert for a vacuum cleaner hose, it is to be understood that the various features of this invention can be utilized singly or in various combinations thereof to provide an insert for other structures as desired.

Therefore, this invention is not to be limited to only the embodiments illustrated in the drawings, because the drawings are merely utilized to illustrate one of the wide variety of uses of this invention.

Figure 5:
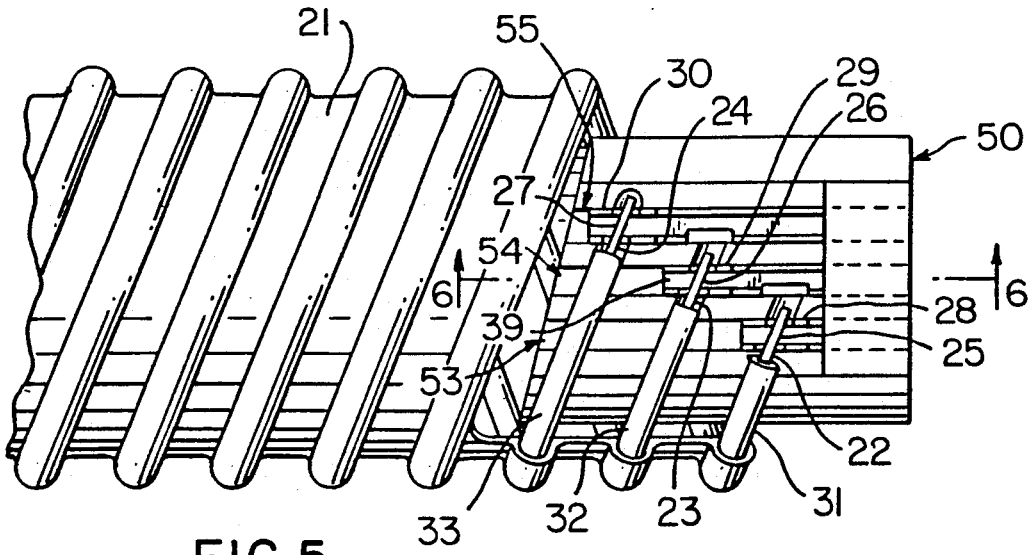
FIG. 5 is an enlarged fragmentary view of the insert of FIG. 4 having the terminal connectors carried thereby and interconnected to the end portions of the conductors of the hose that subsequently forms the hose construction of FIG. 1.

Referring now to FIGS. 1 and 5, the new vacuum cleaner hose construction of this invention is generally indicated by the reference numeral 20 and comprises an elongated vacuum hose 21 having one or more electrical conductors, such as metallic conductors 22, 23 and 24 extending therealong and being respectively provided with end portions 25, 26 and 27 and a plurality of electrical terminal connectors 28, 29 and 30 respectively fixed to the end portions 25, 26 and 27 in a manner hereinafter set forth, the vacuum hose 21 being formed of any suitable material, such as polymeric material, and having the conductors 22, 23 and 24 helically disposed therealong and embedded therein in a conventional manner so that not only must the polymeric material of the hose 21 be removed from the end portions 25, 26 and 27 thereof, but also any original insulation means 31, 32 and 33 on the wire conductors 22, 23 and 24 must be removed so as to permit the terminal connectors 28, 29 and 30 to be fastened thereto in a manner hereinafter set forth. However, it is to be understood that the original insulation means need not be removed from the end portions 25, 26 and 27 of the conductors 22, 23 and 24 as the terminal connectors 28, 29 and 30 will sever through such insulation means and make electrical contact with the electrical conductors for a purpose that is conventional in the art and is fully set forth in the aforementioned Holden U.S. Pat. No. 3,928,715 and the aforementioned Holden et al. U.S. Pat. No. 4,740,171 whereby these two patents are being incorporated into this disclosure by this reference thereto.

Figure 7:
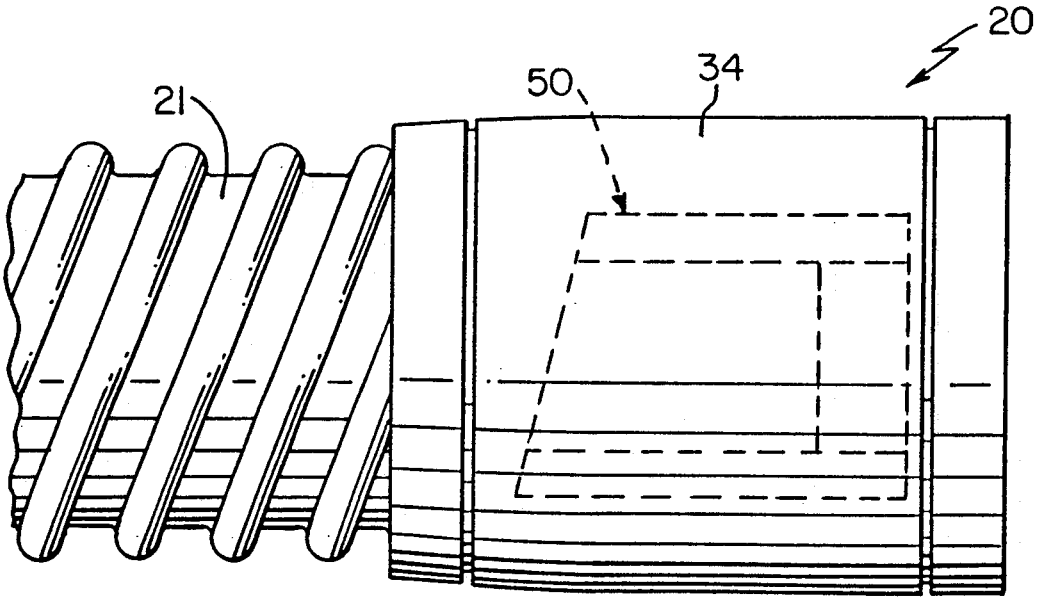
FIG. 7 is a view similar to FIG. 5 and illustrates the hose construction after the end cuff has been disposed thereon to complete the hose construction as illustrated in FIG. 1.

Therefore, since it is well known to fasten one or more terminal connectors respectively to one or more conductors that are originally embedded in a helical manner along a vacuum cleaner hose and thereafter dispose an annular end cuff of polymeric material over the resulting terminal assembly in the manner provided by the end cuff 34 of the hose construction 20 of FIG. 1 and FIG. 7, as well as to provide terminal connectors and an end cuff at the other end (not shown) of the hose 21 in order to complete the hose construction 20 for use with a vacuum cleaner in a conventional manner, only the details of the hose construction 20 of this invention that is necessary to understand the features of this invention will now be set forth as the other structure and details of a vacuum cleaner hose construction are conventional in the art as fully set forth in the aforementioned Holden U.S. Pat. No. 3,928,715 and the Holden et al. U.S. Pat. No. 4,740,171.

Also, because the terminal connectors 28, 29 and 30 are identical except for the length thereof, as is evidenced by FIGS. 4 and 5, only the terminal connector 29 will now be described with the understanding that such structure applies to the other terminal connectors 28 and 30.

Figure 4:
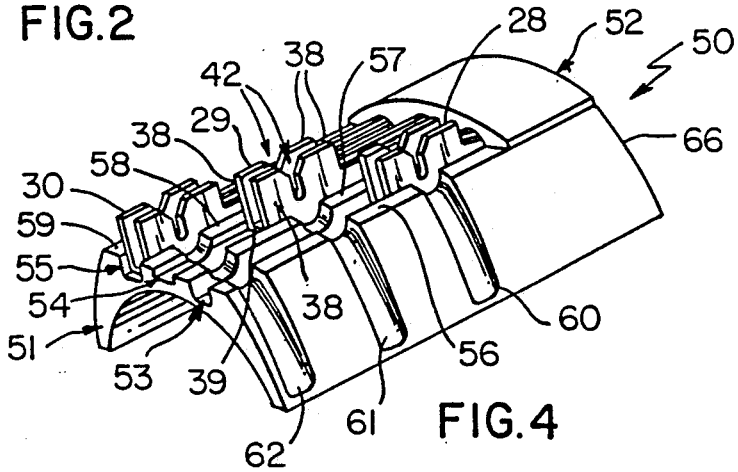
FIG. 4 is a view similar to FIG. 2 and illustrates the insert of FIG. 2 after the terminal connectors have been assembled to the insert and before the end portions of the conductors of the vacuum cleaner hose are attached thereto.
Figure 6:
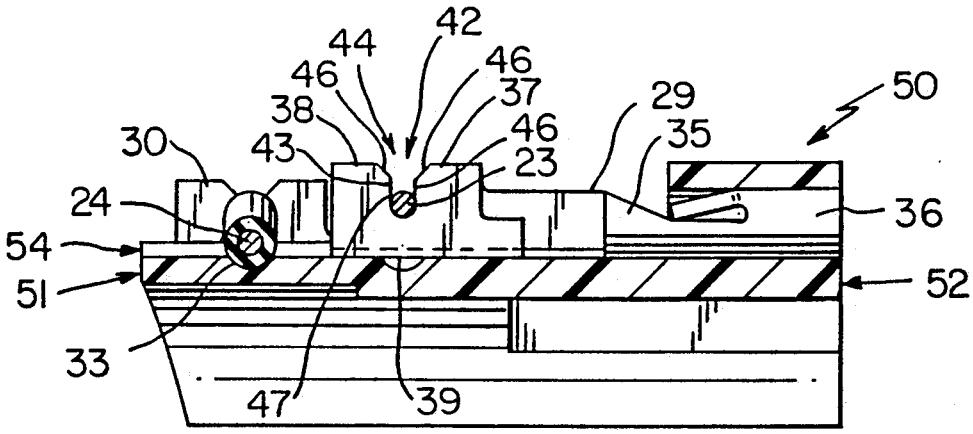
FIG. 6 is an enlarged fragmentary cross-sectional view taken on line 6—6 of FIG. 5.

As illustrated in FIGS. 4, 5 and 6, the terminal connector 29 is formed from any suitable metallic material and has a body portion 35 provided with opposed ends 36 and 37, the end 36 being suitably shaped to either comprise a female means or a male means for interconnecting to another electrical conductor in a manner well known in the art.

The end 37 of the body portion 35 of the connector 29 is defined by a pair of knife-like portions 38 being disposed and held in spaced apart substantially parallel relation by a substantially flat bridging portion 39 of the connector 29 whereby the knife-like portions 38 and bridging portion 39 define a generally U-shaped cross-sectional configuration that faces away from the bridging portion 39 as illustrated.

The knife-like portions 38 of the terminal connector 29 each has a slot 42 therein that is defined by opposed side edges 43. Each slot 42 has an open end 44 being defined by the side edges 43 diverging away from each other to provide cam surfaces 46 that lead to generally straight and parallel sections 47 of the side edges 43 while the closed end 45 of the slot 42 is substantially semicircular as illustrated. The straight parallel sections 47 of the side edges 43 are spaced apart a distance that is slightly less than the diameter of the respective conductor 23 so as to not only cut through any insulating coating thereon, but also to cut slightly into the actual metal of the conductor 23 when the end portion 26 thereof is disposed down into the slots 42 of the knife-like portions 38 of the terminal connector 29 as illustrated in FIGS. 5 and 6. In this manner, the conductor 23 is wedged between the opposed side edges 43 of the knife-like portions 38 to provide an electrical connection between the conductor 23 and the terminal connector 29.

While the knife-like portions 38 of the terminal connector 29 are shown as being single thickness sections of metal, it is to be understood that the same could be a plurality of sections folded against each other such as set forth in the aforementioned Holden U.S. Pat. No. 3,928,715 and the slots 42 can have other than the generally U-shape thereof such as being suitably keyhole shape as set forth in the aforementioned Holden U.S. Pat. No. 3,928,715, if desired.

Also, it is to be understood that additional holding means can be utilized to hold the end portion 26 of the conductor 23 in the slots 42 of the knife-like portions 38 after the end portion 26 has been disposed therein or at the same time that the end portion 26 is being disposed therein as fully set forth in the aforementioned Holden et al. U.S. Pat. No. 4,740,171.

In any event, it has been found according to the teachings of this invention that when disposing the cuff 34, if the same has been preformed, or in forming the cuff 34 by molding the same onto the end 48 of the hose 21 after the terminal connectors 28, 29 and 30 have been fastened to the end portions 25, 26 and 27 of the electrical conductors 22, 23 and 24 in the manner previously set forth, the terminal connectors 28, 29 and 30 must be properly positioned so that the same will not short across each other and will permit the ends 36 thereof to be properly aligned and to be properly spaced apart in the holding cuff structure 34 such as illustrated in FIG. 1 to permit electrical interconnection thereto in a manner well known in the art.

Accordingly, it was found according to the teachings of this invention that a unique insert that is generally indicated by the reference numeral 50 can be utilized to initially properly hold the terminal connectors 28, 29 and 30 in their assembled relation with the conductors 22, 23 and 24 to readily permit the cuff 34 to be disposed on the end 48 of the hose 21 whether or not that end cuff 34 has been preformed or is being formed by a molding operation on the end 48 of the hose 21 as will be apparent hereinafter.

The insert 50 of this invention can be formed of any suitable material, such as polymeric material, and can be sufficiently rigid so that the same can hold the terminal connectors 28, 29 and 30 in their proper positions during the time the cuff 34 is being disposed on the end 48 of the hose 21.

Figure 2:
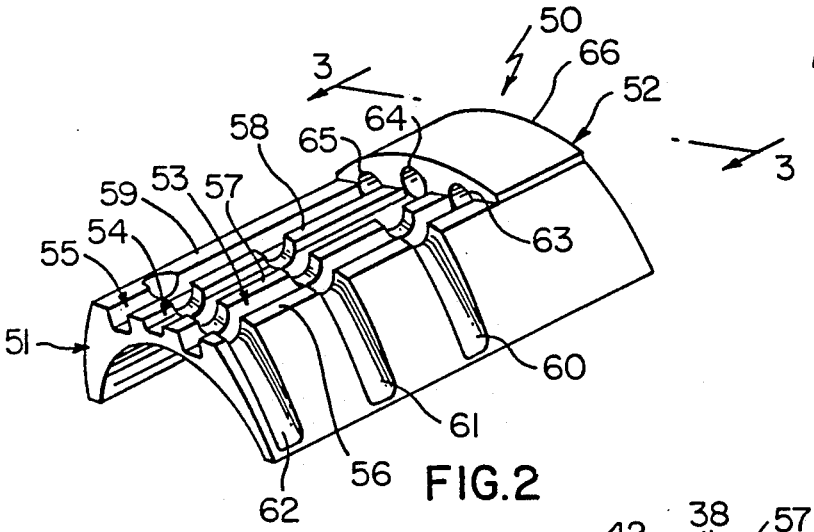
FIG. 2 is an enlarged perspective view of the insert of this invention that is utilized with the vacuum cleaner hose construction of FIG. 1.

The insert 50 as illustrated in FIGS. 2, 4 and 6 has opposed end means 51 and 52 with the end means 51 having a plurality of elongated slots 53, 54 and 55 formed therein and being disposed in spaced apart parallel relation and of sufficient width so that the ends 37 of the terminal connectors 28, 29 and 30 can be respectively disposed therein and even be frictionally held therein by being slightly press-fitted into the slot means 53, 54 and 55, if desired.

In this manner, it can be seen that an upstanding wall 56 is disposed on one side of the slot means 55 while another upstanding wall 57 is disposed on the other side of the slot means 53 as well as on one side of the slot means 54. In addition, an upstanding wall 58 is disposed intermediate the slot means 54 and 55 while a remaining upstanding wall 59 is disposed on the other side of the slot means 55.

The end portion 51 of the insert 50 has three angular groove means 60, 61 and 62 formed therein and being so arranged that the groove means 60, 61 and 62 cut through the walls 56 and 57 while only the grooves 61 and 62 cut through the wall 58 and only the groove 61 cuts through the wall 59 for a purpose that will be readily apparent hereinafter, the groove means 60, 61 and 62 being angled and spaced apart so as to mate with the natural angle and spacing of the conductors 22, 23 and 24 as will be apparent hereinafter and as illustrated in FIG. 5.

The other end portion 52 of the insert 50 has a plurality of opening means 63, 64 and 65 passing completely therethrough and being respectively in axially aligned relation with the slot means 53, 54 and 55, the diameter of the openings 63, 64 and 65 being slightly larger than the diameters of the end portions 36 of the terminal connectors 28, 29 and 30 so that the same can be readily and slightly press-fitted therein in the manner illustrated in FIG. 6 and extend to the free end 66 of the insert 50 so as to permit electrically coupling thereto in a manner well known in the art.

In this manner, once the terminal connectors 28, 29 and 30 have their ends 36 respectively disposed in the opening means 63, 64 and 65 so as to extend to the end 66 thereof, the other end portions 37 thereof will be respectively aligned with the angular grooves 60, 61 and 62 in such a manner that while the knife-like portions 38 are disposed in the slot means 53, 54 and 55, the end portions 25, 26 and 27 of the conductors 22, 23 and 24 can readily extend through the walls 56, 57, 58 and 59 as illustrated in FIG. 5 and thereby permit the end portions 25, 26 and 27 to be disposed into the slots 42 of the terminal connectors 28, 29 and 30 as illustrated, the insulation means 31, 32 and 33 of the conductors 22, 23 and 24 that have not been removed readily being received in the grooves 60, 61 and 62 as illustrated.

In this manner, not only are the terminal connectors 28, 29 and 30 held in their proper spaced apart parallel relation by the slot means 53, 54, 55 and their associated openings 63, 64 and 65, but also the conductors 22, 23 and 24 are held in the proper angular and spaced apart helical relation by the grooves 60, 61 and 62 after the end portions 25, 26 and 27 thereof have been properly positioned in the slot means 42 of the terminal connectors 28, 29 and 30 as illustrated.

Thereafter, the end cuff 34 can be readily disposed on the end 48 of the hose 21 to not only at least partially cover the connectors 28, 29 and 30 and the conductors 22, 23 and 24 at the end portion 25, 26 and 27 thereof, but also to at least partially cover the insert 50. Of course, if the end cuff 34 is actually molded onto the end 48 of the hose 21, such molding operation will not only embed the conductors 22, 23 and 24 and the terminal connectors 28, 29 and 30 therein, but also the molding operation will embed the insert 50 therein in the manner fully illustrated in FIGS. 1 and 7.

Therefore, it can be seen that the insert 50 of this invention will hold not only the terminal connectors 28, 29 and 30, but also will hold the conductors 22, 23 and 24 in their proper positions during the forming of the end cuff 34 onto the end 48 of the hose 21.

While one type of terminal connector has been illustrated in the drawings, it is to be understood that this invention is not to be limited to this particular configuration as electrical termination for the conductors 22, 23 and 24 could be accomplished by butt type connectors, soldering, welding, two component logic type connectors, etc. Also, this invention is not to be limited to having electrical receptacles as provided by the ends 36 thereof as the same could comprise electrical male pins, tabs, or any other means of electrical connection concept. In addition, while the insert 50 of this invention has been illustrated and described as providing three slot means 53, 54 and 55 for three terminal connectors, it is to be understood that the insert 50 can have just one slot means or any desired number of slot means so as to provide for one or any desired number of terminal connectors as desired as the hose construction 21 could have one or any desired number of conductors extending therealong as desired.

Therefore, it can be seen that this invention not only provides a new vacuum cleaner hose construction and method of making the same, but also this invention provides an insert for a vacuum cleaner hose construction and a method of making the insert.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a vacuum cleaner hose construction that comprises an elongated vacuum hose having an end and an electrical conductor extending helically therealong and being provided with an end portion at said end, an electrical terminal connector carried by said hose and being fixed to said end portion, and an insert for holding said connector and its interconnected end portion in a predetermined position, the improvement wherein said insert has opposed ends one of which has a substantially straight slot means therein and an angular groove means therein leading to said slot means and intersecting the same at an angle relative thereto, the other of said opposed ends of said insert having opening means therein, said connector having opposed ends respectively disposed in said slot means and said opening means to be held thereby, said end portion of said conductor being disposed in said angular groove means.

2. A hose construction as set forth in claim 1 wherein said hose is made mainly of polymeric material.

3. A hose construction as set forth in claim 2 wherein said insert is also made mainly of polymeric material.

4. A hose construction as set forth in claim 1 wherein the end of said connector that is disposed in said slot means of said insert comprises the part of said connector that is interconnected to said end portion of said conductor.

5. A hose construction as set forth in claim 4 wherein said end of said connector that is disposed in said slot means of said insert comprises a pair of spaced apart knife-like portions each being provided with opposed edges defining sides of a slot therein that has an open end and a closed end, said knife-like portions of said connector having said open ends of said slots thereof facing in the same direction and being interconnected together at one end thereof to an intermediate part of said connector whereby said portions and said part define a U-shaped configuration that has a bight facing in the same direction as said open ends of said slots, said end portion being disposed in said slots of said connector and being wedged between said opposed edges thereof for providing electrical connection therebetween.

6. A hose construction as set forth in claim 1 wherein said hose has a plurality of said electrical conductors extending helically therealong with each being provided with said end portion and wherein said construction has a plurality of said connectors respectively fixed to said end portions in a like manner, said insert initially holding said connectors and their interconnected end portions in predetermined positions relative to each other in a like manner whereby said insert has a plurality of said slot means therein and a plurality of said angular grove means therein respectively leading to said slot means and intersecting the same at angles relative thereto.

7. A hose construction as set forth in claim 6 wherein said connectors are held in spaced apart substantially parallel relation by said insert.

8. In an insert for a vacuum cleaner hose construction that comprises an elongated vacuum hose having an end and an electrical conductor extending helically therealong and being provided with an end portion at said end, and an electrical terminal connector carried by said hose and being fixed to said end portion, said insert having means for holding said connector and its interconnected end portion in a predetermined position, the improvement wherein said insert has opposed ends one of which has substantially straight slot means therein and an angular groove means therein leading to said slot means and intersecting the same at an angle relative thereto, the other of said opposed ends of said insert having opening means there whereby the opposed ends of said connector are adapted to be respectively disposed in said slot means and said opening means to be held thereby and said end portion of said conductor is adapted to be disposed in said angular groove means.

9. An insert as set forth in claim 8 wherein said insert is made mainly of polymeric material.

10. An insert as set forth in claim 8 wherein said hose has a plurality of said electrical conductors extending helically therealong with each being provided with said end portion of said connector being fixed thereto, said insert initially being adapted to hold said connectors and their interconnected end portions in predetermined positions relative to each other in a like manner whereby said insert has a plurality of said slot means therein and a plurality of said angular groove means therein respectively leading to said slot means and intersecting the same at angles relative thereto.

11. An insert as set forth in claim 10 wherein said insert is adapted to hold said connectors in spaced apart substantially parallel relation.

* * * * *